US007145581B2

(12) United States Patent
Willis

(10) Patent No.: US 7,145,581 B2
(45) Date of Patent: Dec. 5, 2006

(54) SELECTIVELY UPDATING PULSE WIDTH MODULATED WAVEFORMS WHILE DRIVING PIXELS

(75) Inventor: Thomas E. Willis, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 489 days.

(21) Appl. No.: 10/232,150

(22) Filed: Aug. 30, 2002

(65) Prior Publication Data

US 2004/0041825 A1 Mar. 4, 2004

(51) Int. Cl.
*G09G 3/36* (2006.01)

(52) U.S. Cl. ..... 345/691; 345/694; 345/697

(58) Field of Classification Search ..... 345/691, 345/692, 693, 694, 696, 697
See application file for complete search history.

(56) References Cited

U.S. PATENT DOCUMENTS 4,247,853 A * 1/1981 Hamilton et al. ..... 345/12
4,954,951 A * 9/1990 Hyatt ..... 711/218
5,805,126 A * 9/1998 Bassetti ..... 345/89
5,914,764 A 6/1999 Henderson
5,917,464 A 6/1999 Stearns
6,175,355 B1 * 1/2001 Reddy ..... 345/89
6,597,371 B1 * 7/2003 Mandl ..... 345/691
6,597,372 B1 * 7/2003 Huang ..... 345/691
6,833,832 B1 * 12/2004 Wolverton ..... 345/532
2003/0193514 A1 * 10/2003 Huang ..... 345/694

* cited by examiner

*Primary Examiner*—Richard Hjerpe
*Assistant Examiner*—Jean Lesperance
(74) *Attorney, Agent, or Firm*—Trop, Pruner & Hu, P.C.

(57) ABSTRACT

In a display refresh period, an array of display elements (e.g., pixels) forming a display device (e.g., a spatial light modulator) may be driven using selectively updated pulse width modulated waveforms. Decoupling of digital storage, storing display data that generates updated pulse width modulated waveforms, from the array of pixels may provide decoupling of pixel data and pulse width modulated waveform updates. In one embodiment, an update value of pixel data is provided to a display element. Using once the update value, a modulated signal may be generated for a display refresh period to drive the display element, significantly reducing updates required for the pixel data at the display element.

27 Claims, 5 Drawing Sheets

SELECTIVELY UPDATING PULSE WIDTH MODULATED WAVEFORMS WHILE DRIVING PIXELS

BACKGROUND

The present invention relates generally to electro-optical displays, and more particularly to selectively updating pulse width modulated waveforms that digitally drive display elements of a display device.

An array of display elements (e.g., pixels) in a display device may be driven using drive signals, such as modulated waveforms. In doing so, each modulated waveform may individually drive a different pixel of the display device. There are many ways to generate these drive signals. One approach involves using pulse width modulation (PWM) to form drive signals in display systems. By generating pulse width modulated waveforms, pixels with digital storage, such as in liquid crystal displays (LCDs) may be driven. For instance, a spatial light modulator (SLM) uses an electric field to modulate the orientation of a liquid crystal (LC) material. By the selective modulation of the LC material, an electronic display of an image may be produced on a screen, as the orientation of the LC material affects the intensity of light going through the LC material. Sandwiching of the LC material between an electrode and a transparent top plate, for example, may enable the modulation of the optical properties of the LC material. When the voltage applied across the electrode and the transparent top plate is changed, the LC material may produce different levels of output intensity, altering the image produced on the screen.

Typically, a display system includes a display device that receives data or content to be displayed in adjacent frames from a frame buffer memory within display refresh periods. More specifically, appropriate pixel data or value may be sent to each pixel. However, allowing a duty cycle of a drive signal to vary as a function of a pixel value within a display refresh period may result in multiple reads of display data, such as frame data from a frame buffer memory. While driving a pixel, several existing PWM-based schemes rely on an update of a PWM waveform based on an update of the pixel value, requiring large bandwidth between the frame buffer memory and pixel. Moreover, generation of such a frequently updated PWM waveform may not effectively control the LC material, resulting in a relatively poor quality display. Specifically, while displaying an image, this continuous updating of the PWM waveforms may result in numerous intermediate optical outputs from pixels that are being driven. That is, this technique may produce undesired, multiple, intermediate sub-levels of intensity while transitioning between different desired levels of intensity.

Thus, there is a need for better ways to controllably drive display elements in display systems with available digital storage.

DETAILED DESCRIPTION

Figure 1:
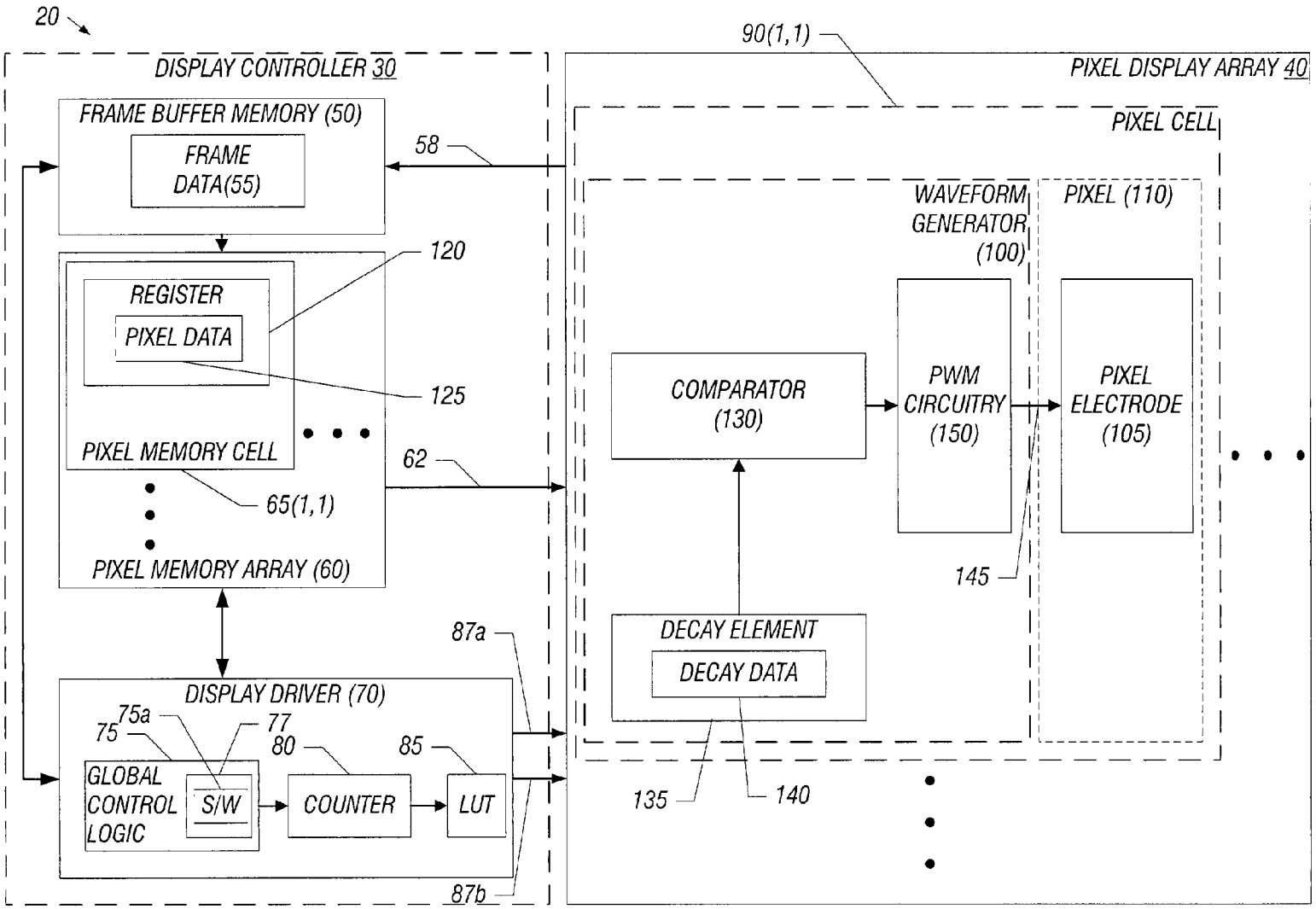
FIG. 1 is a schematic depiction of a display device with decoupled digital storage useful for generating pulse width modulation (PWM) waveforms in accordance with one embodiment of the present invention.

A display device 20 comprising physically separated digital storage is shown in FIG. 1 to store display data that generates one or more updated modulated signals (e.g., pulse width modulation (PWM) waveforms) in a manner that is decoupled from updating of the display data. Specifically, the display device 20 may comprise a display controller 30 including a frame buffer memory 50, storing frame data 55, such as video data to digitally drive a pixel display array 40 in some embodiments of the present invention. In addition, the display controller 30 may include a pixel memory array 60 comprising a plurality of pixel memory cells 65 including a pixel memory cell 65 (1, 1). The display controller 30 may further comprise a display driver 70 that includes a global control logic 75, controlling a counter 80 which may provide reference data to a look-up-table (LUT) 85 in one embodiment of the present invention. Consistent with one embodiment of the present invention, the global control logic 75 may incorporate a storage device 77, storing associated global control software 75*a*.

In one embodiment, the pixel display array 40 includes a plurality of pixel cells 90 including a pixel cell 90 (1, 1). Each pixel cell 90 may be associated with a particular pixel memory cell 65 of the pixel memory array 60 which is physically decoupled from the pixel display array 40. That is, the pixel memory array 60 including the pixel memory cell 65 (1, 1) may be located remotely from the pixel display array 40 including the pixel cell 90 (1, 1). The pixel cell 90 (1, 1) may include a waveform generator 100 to generate a modulated signal for driving a pixel electrode 105 that forms a pixel 110 in one embodiment. To this end, frame data 55 comprising per-pixel display data or value may be provided within the pixel memory cell 65 (1, 1) for the associated pixel 110. A storage element, such as a register 120 may store a pixel data or value 125 at the pixel memory cell 65 (1, 1) in one embodiment of the present invention.

The waveform generator 100 may include a comparator 130 to compare data, a decay element 135 (e.g., a counter, capacitor or a device capable of changing a state of a stored value at a desired rate) to store decay data 140, and pulse width modulation (PWM) circuitry 150 to form the modulated signal. From the register 120, the pixel data or value 125 may be provided as the decay data 140 to the decay element 135. Based on the state of the decay data 140, the PWM circuitry 150 may form the modulated signal over a link 145 for driving the pixel electrode 105 of the pixel 110.

For initiating a display of a video frame corresponding to the frame data 55 within a display refresh period, the display driver 70 may provide a start signal 87*a*. Using the start signal 87*a*, the waveform generator 100 may set the modulated signal over the link 145 to an "ON" logic state at the beginning of the video frame. Besides, in response to a load signal 58 from the pixel display array 40 to the frame buffer memory 50, the pixel data or value 125 may be provided via a local video data signal 62 to the pixel cell 90 (1, 1). To drive the pixel 110, the waveform generator 100 uses the PWM circuitry 150 located at the pixel cell 90 (1, 1).

Specifically, within each display refresh period, an updated pixel data or value 125 may be received at the decay element 135 from the pixel memory cell 65 (1, 1) of the pixel memory array 60 in accordance with one embodiment of the present invention. Thereafter, the updated pixel data or value 125 may be stored at the decay element 135 as the decay data 140. The updated pixel data or value 125 may be indicative of an optical output (e.g., intensity) from the pixel 110 in some embodiments of the present invention.

In some embodiments, the updated pixel data or value 125 may be provided only once to the pixel memory cell 65 (1, 1) within a display refresh period from the frame buffer memory 50 that stores the frame data 55 associated with the pixel 110. Accordingly, using the updated pixel data or value 125, i.e., based on a state of the decay data 140, the modulated signal may be updated once per display refresh period. This updated modulated signal may drive the pixel 110 for a whole display refresh period. In one embodiment, for each display refresh period the modulated signal may include one transition separating a first pulse from a second pulse.

In operation, the decay element 135 may divide the display refresh period into discrete steps, such as a first and a second time interval. From the LUT 85, a first reference data corresponding to the first time interval, such as a global count value may be provided across each pixel cell 90 at the associated comparator 130. Likewise, a second reference data corresponding to the second time interval may be sent to the comparator 130. In one embodiment, the global count value may be common with all the pixel cells 90. As an example, the display driver 70 may provide the global count value via a global count data signal 87*b* to each pixel cell 90 for coordinating the display of an image across the pixel display array 40.

In order to generate the modulated signal, the comparator 130 may compare the first reference data to the second reference data. Based on this comparison and the updated pixel data or value 125, a modulated signal including one transition separating a first pulse from a second pulse may be generated for the pixel 110 by the waveform generator 100 within the display refresh period. By tracking the number of times the modulated signal may potentially change a logic state against a threshold, the timing of this transition in the modulated signal may be derived at the pixel cell 90 (1, 1). In response to reaching the threshold, the timing of the transition may cause a change of the logic state for the modulated signal. The threshold may be a maximum count that is compared against a current count of the decay element 135. For example, when a display refresh period is divided into discrete steps, at each step, the waveform generator 100 may elect to change the state of the pixel 110 based on the step count and the updated pixel data or value 125.

One operation according to an embodiment of the present invention involves dynamically receiving the updated pixel data or value 125 as the decay data 140 at the decay element 135 and the first and second reference data at the comparator 130. The first and second reference data (e.g., global count values) may be common with respect to another pixel (not shown, although similar to the pixel 110). Depending upon the state of the first and second reference data and the state of the decay data 140, the modulated signal (e.g., a PWM waveform) is generated with a single transition separating a first pulse from a second pulse. Instead of relying upon addition of multiple non-overlapping waveforms for building a PWM waveform, the pixel 110, in turn, may be illuminated for a desired duration based on the single transition in the modulated signal within the display refresh period. To provide an optical output, i.e., produce different levels of intensities based on a comparison result at the comparator 130 and the state of the decay data 140, the pixel 110 may be driven from the modulated signal being updated over the link 145 accordingly. In this way, each modulated signal may be selectively updated while digitally driving the pixels 110.

In one embodiment, the pixel 110 may belong to a light modulator, such as a spatial light modulator (SLM) including a plurality of pixels. Using an array of the pixel cells 90 (1, 1) through 90 (n, m) (not shown), an SLM device (for example, a display device with a liquid crystal material (LC)) may be driven by electronics located under each pixel. Such pixel architecture may enable a direct digital driving of the SLM device. Of course, there are many reasonable pixel architectures for these devices, each of which have implications on how the LC material is driven. For example, a digital pixel architecture may store a color value under the pixel in a digital fashion. This enables the pixel architectures that use pulse-width modulation to produce color in SLM devices. In one approach, the LC material is driven by a signal PWM waveform where "ON" time is a function of the desired color value.

According to one embodiment, a liquid crystal over silicon (LCOS) technology may be used to form the pixels 110 of the pixel display array 40. Liquid crystal devices formed using the LCOS technology may form large screen projection displays or smaller displays (using direct viewing rather then projection technology). Typically, the liquid crystal (LC) material is suspended over a thin passivation layer. A glass plate with an indium tin oxide (ITO) layer covers the liquid crystal, creating the liquid crystal unit sometimes called a cell. A silicon substrate may define a large number of pixels. Each pixel may include semiconductor transistor circuitry in one embodiment.

Figure 2:
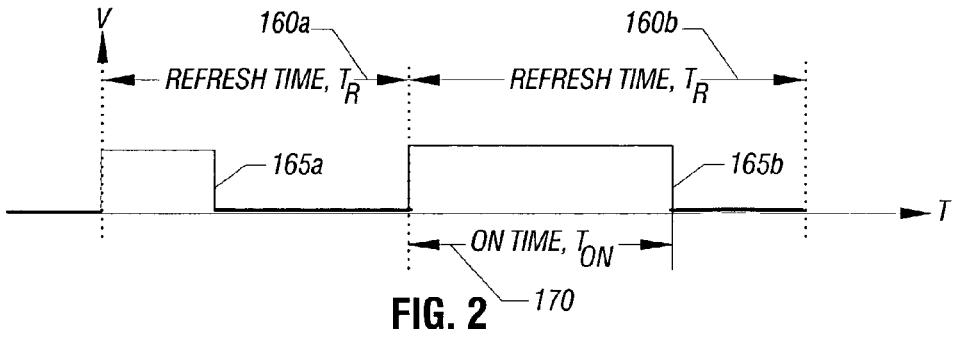
FIG. 2 is a hypothetical graph of applied voltage versus time for a spatial light modulator (SLM) consistent with one embodiment of the present invention.

A hypothetical graph of applied voltage versus time (e.g., a modulated signal, as a PWM waveform) for a display device (e.g., a spatial light modulator (SLM)) is shown in FIG. 2 in accordance with one embodiment of the present invention. Within a first display refresh time period, $T_R$, 160*a*, the modulated signal including a first transition 165*a* and during the next cycle, i.e., within a second refresh time period, $T_R$, 160*b*, the modulated signal including a second transition 165*b* may be applied to the pixel electrode 105 of FIG. 1, for example. Each of the first and second transitions 165*a*, 165*b* separates the modulated signal in first and second pulse intervals. The first pulse interval of the second display refresh time period 160*b* is indicated as the "ON" time, $T_{on}$ 170, as an example. The remaining portion of the second display refresh time period 160*b* after the second transition 165*b* is the second pulse interval which may be the "OFF" time.

In some embodiments, the "ON" time, $T_{on}$ 170, of the modulated signal of FIG. 2 is a function, $f_{pwm}$, of the current pixel data or value 125, p, where $p \in [0, 2^n-1]$, n is the number of bits in a color component (typically 8 for some display systems), $T_{on} \in [0, T_R]$, and $T_R$ is a constant refresh time. The first and second display refresh periods, i.e., $T_R$, 160*a* and 160*b*, may be determined depending upon the response time, i.e., $T_{resp}$, of the liquid crystal (LC) material along with an update rate, i.e., $T_{update}$, (e.g., the frame rate) of the content that the pixel 110 (FIG. 1) may display when appropriately driven.

Ideally, the display refresh periods, i.e., $T_R$, 160*a* and 160*b* may be devised to be shorter than that of the update rate, $T_{update}$, of the content, and the minimum "ON" time, minimum ($T_{on}$), may be devised to be larger than the response time, $T_{resp}$, of the LC material. However, $T_{on}$ 170, may be time varying as the pixel data or value 125 may change over time. In one embodiment, a non-linear function is used for $f_{pwm}$ to match this function with other non-linear aspects of the pixel 110. The function $f_{pwm}$ may be realized through a variety of conventional hardware.

All the pixel cells 90 (1, 1) through 90 (n, m) in the pixel display array 40 may not be of the same shape or size, nor that the pixel display array 40 be rectangular or regular. In some embodiments, it may be desirable that only a subset of the pixel cells 90 of the display device 20 be built according to the configuration shown for the pixel cell 90 (1, 1). For example, a display device might have a low-resolution area in which the pixels 110 are large enough that it is acceptable, or perhaps even desirable, that the pixel value storage be located under the respective pixel cells 90, and a high-resolution area in which the pixel storage is located elsewhere. In such cases, the pixel storage could be located remotely from the entire display, or it might be located under the low-resolution area's cells.

Essentially, each pixel cell 90 includes a respective waveform generator 100 to drive the pixel electrode 105 of an associated pixel 110 in one embodiment. Each waveform generator 100 may generate a pulse-width modulation (PWM) waveform to digitally drive the associated pixel 110. Each waveform generator 100 may be disposed proximate to the associated pixel 110. For example, in accordance with one embodiment each waveform generator 100 may be advantageously located underneath the associated pixel 110.

Figure 3:
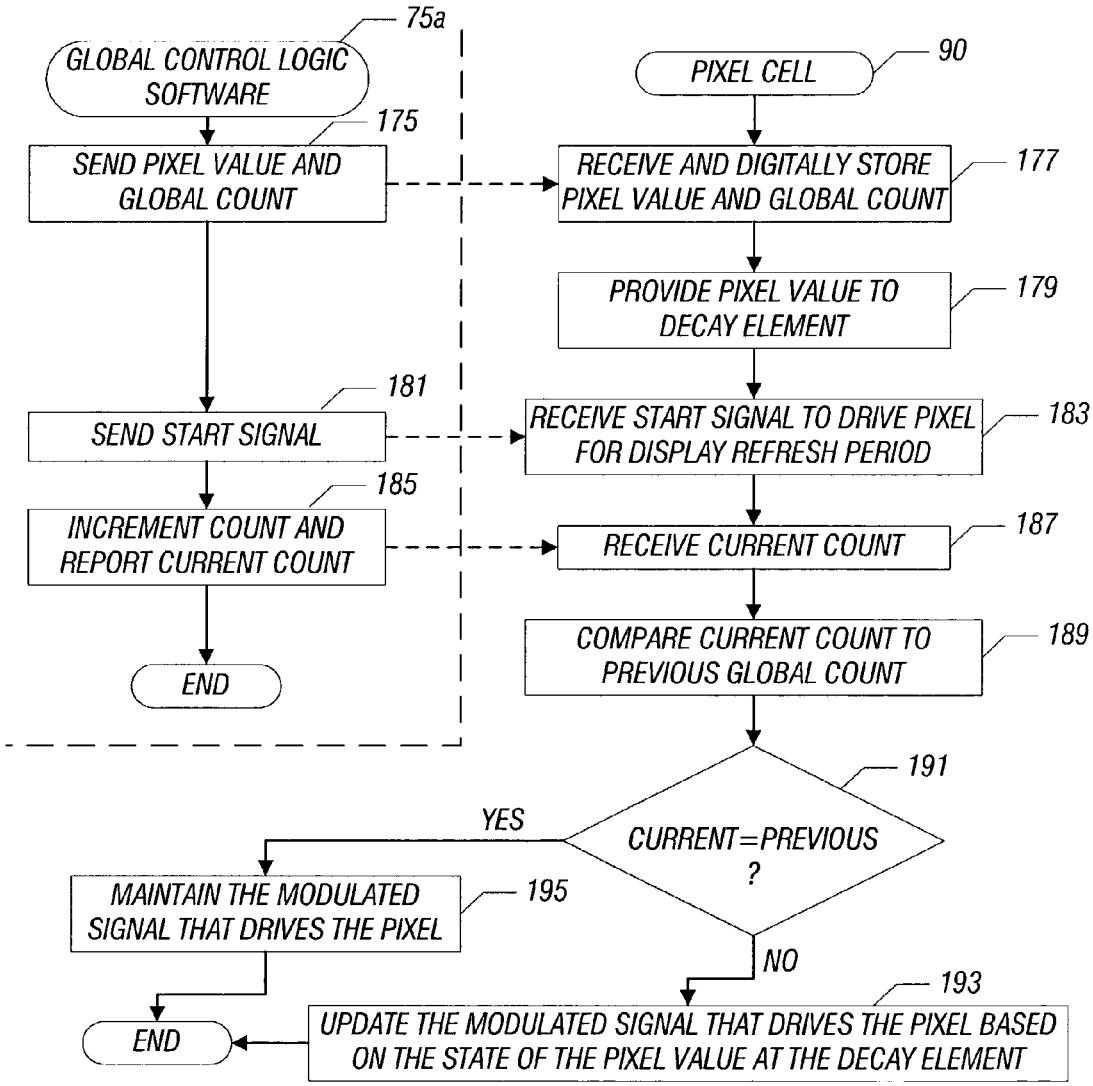
FIG. 3 is a flow chart of a global control logic for controllably driving pixels of the display device of FIG. 1 according to one embodiment of the present invention.

Consistent with one embodiment of the present invention, to selectively update pulse width modulated waveforms while driving pixels 110, the global control software 75*a* controllably drives each pixel cell 90 as shown in FIG. 3. While the pixel data or value 125 associated with each pixel cell 90 may be sent from the pixel memory cell 65 to the decay element 135, the global count values generated by the counter 80 corresponding to the first and second reference data may be provided from the LUT 85 to the comparator 130 at block 175. The pixel data or value 125 and the global count values may be received and subsequently stored digitally in the pixel cell 90 at block 177. The pixel data or value 125 may be provided to the decay element 135 and stored as decay data 140 at block 179. A display signal (for example, the start signal 87*a* shown in FIG. 1) may be asserted by the display driver 70 to initialize the pixel cell 90 at block 181.

At block 183, the pixel cell 90 may receive the start signal 87*a* to drive the pixel 110 within a display refresh period. During the display refresh period, the global control software 75*a* may increment the global count value, i.e., the first reference data, and then report the current global count value as the second reference data to the pixel cell 90, at block 185. For the comparison purposes, the current global count value may be received in the comparator 130 at block 187. Thereafter, the current global count value may be compared to the previous global count value by the comparator 130 at block 189 to determine whether or not to update the state of the pulse width modulated waveform, driving the pixel 110.

A check at diamond 191 may determine whether the current global count value is the same as the previous global count value. If the current global count value is determined to be different from the previous global count value, the modulated signal, i.e., the state of the pulse width modulated waveform that drives the pixel 110 may be updated based on the state of the decay data 140 in the decay element 135 at block 193. That is, a state of the decay data 140 at the decay element 135 determines this selective updating of the modulated signal, driving the pixel 110. Conversely, if the current global count value is determined to be the same as the previous global count value at the diamond 191 then, the state of the modulated signal that drives the pixel 110 may be maintained at a current logic state.

In this manner, only one read of the pixel data or value 125 and one comparison of the reference data may be performed per display refresh period in one embodiment of the present invention. For instance, if current global count value (e.g., LUT[t]0 provided from the LUT 85 at time "t" and previous global count value (e.g., LUT[t−1]) at time "t−1" are equal and the state of the decay data 140 is such that a state transition is not indicated, then the logic state of the modulated signal, i.e., the pulse width modulated waveform for the pixel 110 at time "t" may not differ from the logic state at time "t−1." Therefore, the pulse width modulated waveform may need not be updated.

Figure 4A:
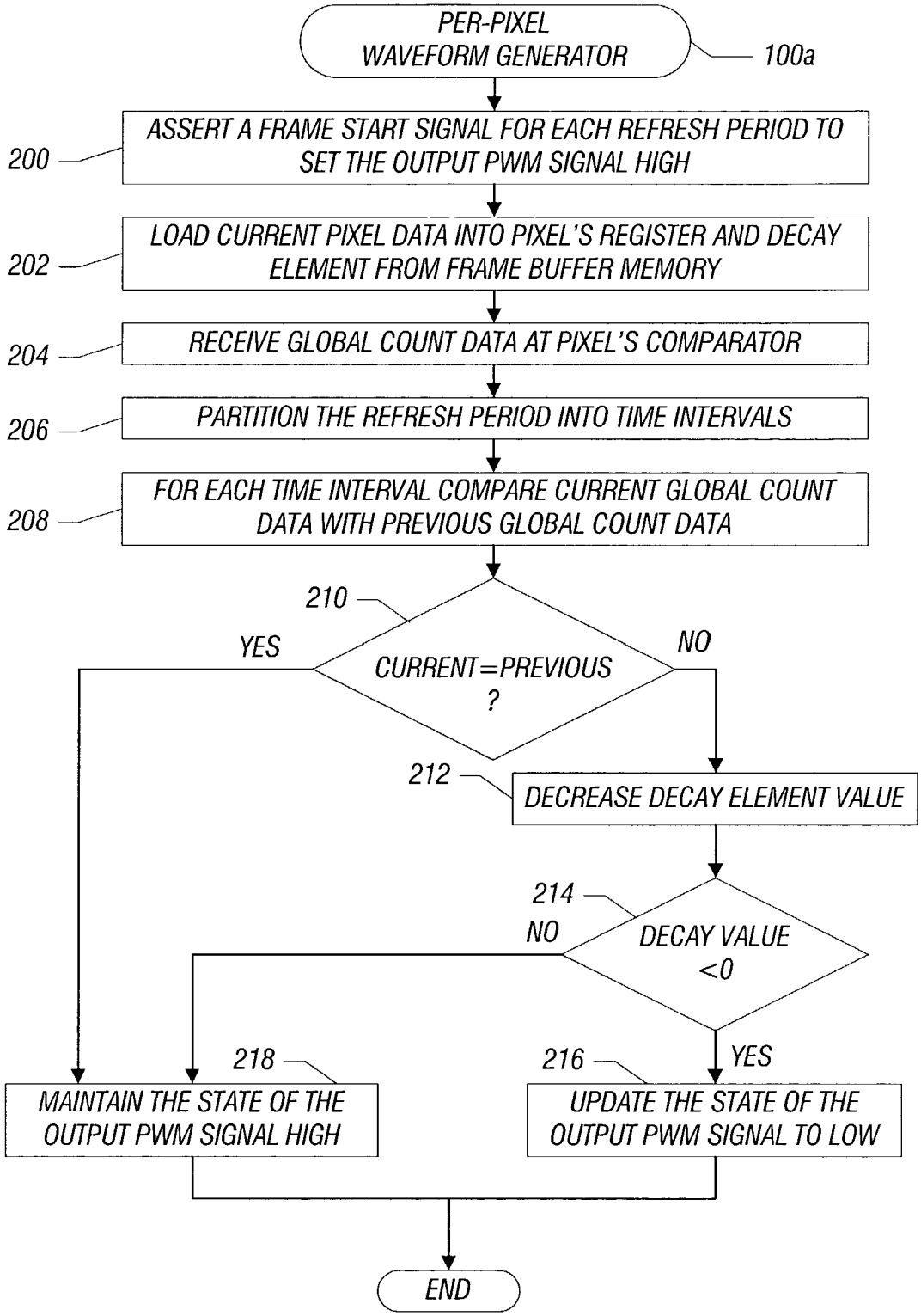
FIG. 4A shows per-pixel waveform generator circuitry to selectively update pulse width modulated waveforms while driving pixels of the display device of FIG. 1 according to one embodiment of the present invention.

Turning now to FIG. 4A, per-pixel waveform generator circuitry 100*a* with the comparator 130 capable of performing at least two different comparisons may selectively update an output pulse width modulated (PWM) signal while driving the pixel 110 (FIG. 1) in accordance with one embodiment of the present invention. To set the output PWM signal high, i.e., to a high logic state (e.g., a digital logic level "1"), a frame start signal (e.g., the start signal 87*a*) may be asserted for each display refresh period at block 200. To this end, the load signal 58 may be first provided from the pixel display array 40 to the frame buffer memory 50, as shown in FIG. 1. In response to the load signal 58, current pixel 110 data within the frame data 55 may be transferred from the frame buffer memory 50 to the pixel memory cell 65 (1, 1), and further copied to the decay element 135 at block 202, in one embodiment. At block 204, global count values corresponding to the first and second reference data may be received at the pixel cell 90 (1, 1). In particular, each global count value is transferred from the display driver 70 over the global count data signal 87*b* to the comparator 130.

Consistent with one embodiment of the present invention, the decay element 135 may be a counter that reduces its counter value by one each time the state of the pulse width modulated waveform may potentially change. In one case, the decay element 135 may be a down counter which may be loaded with the pixel data or value 125 at the start of a display refresh period. Each time the state of the PWM waveform may potentially change, the counter value decays by one. A display refresh period may be partitioned into time intervals, such as a particular number of time steps at block 206 in one embodiment of the present invention. This partitioning of the display refresh period may be done by the decay element 135 which may be a counter (for example, a down counter) in one embodiment of the present invention. For each time interval, current global count value may be compared to the previous global count value at block 208.

A check at diamond 210 may determine whether the current global count value is the same as the previous global count value. If the two global count values are different, the decay data 140 stored at the decay element 135 may be decreased in value, such as by one. A check at diamond 214 may track the decay data value. If the decay data value is determined to be less than zero, then the state of the output PWM signal may be updated to a low state (for example, a digital logic level "0"), at block 216. Alternatively, if the decay data value is determined to be greater than zero at the diamond 214, the state of the output PWM signal is maintained at a high logic level (e.g., a digital logic level "1"). In this way, for each display refresh period partitioned into one or more time intervals, the per-pixel waveform generator circuitry 100*a* may run this routine iteratively for each time interval according to one embodiment of the present invention. More specifically, the frame buffer memory 50 may be read only once in each display refresh period in order to determine the state of the output PWM signal (e.g., the modulated signal over the link 145 as shown in FIG. 1) in one embodiment of the present invention.

In one embodiment, the comparator 130 may make a state transition decision by mapping a counter value indicative of the decay data 140 into an n-bit space (where "n" is the number of bits in the pixel data or value 125 earlier copied as the decay data 140). That is, the state transition decision may involve an assertion that the state of the pulse width modulated waveform for the pixel 110 corresponding to the pixel data or value 125 may be changed if the pixel data or value 125 is determined to be less than the mapping of the current counter value onto the n-bit space.

Accordingly, the output PWM signal may be tracked for the number of potential transition points against a transition count indicative of a change in a logic state of the output PWM signal. Based on the transition count, a logic state of the output PWM signal may be determined in one embodiment of the present invention. That is, the state of the output PWM signal may be determined by comparing the first and second reference data and based on the transition count which indicates a potential change in the logic state. Either an "ON" logic state may be maintained or a single transition may be caused from the "ON" logic state to a "OFF" logic state in the output PWM signal.

Figure 4B:
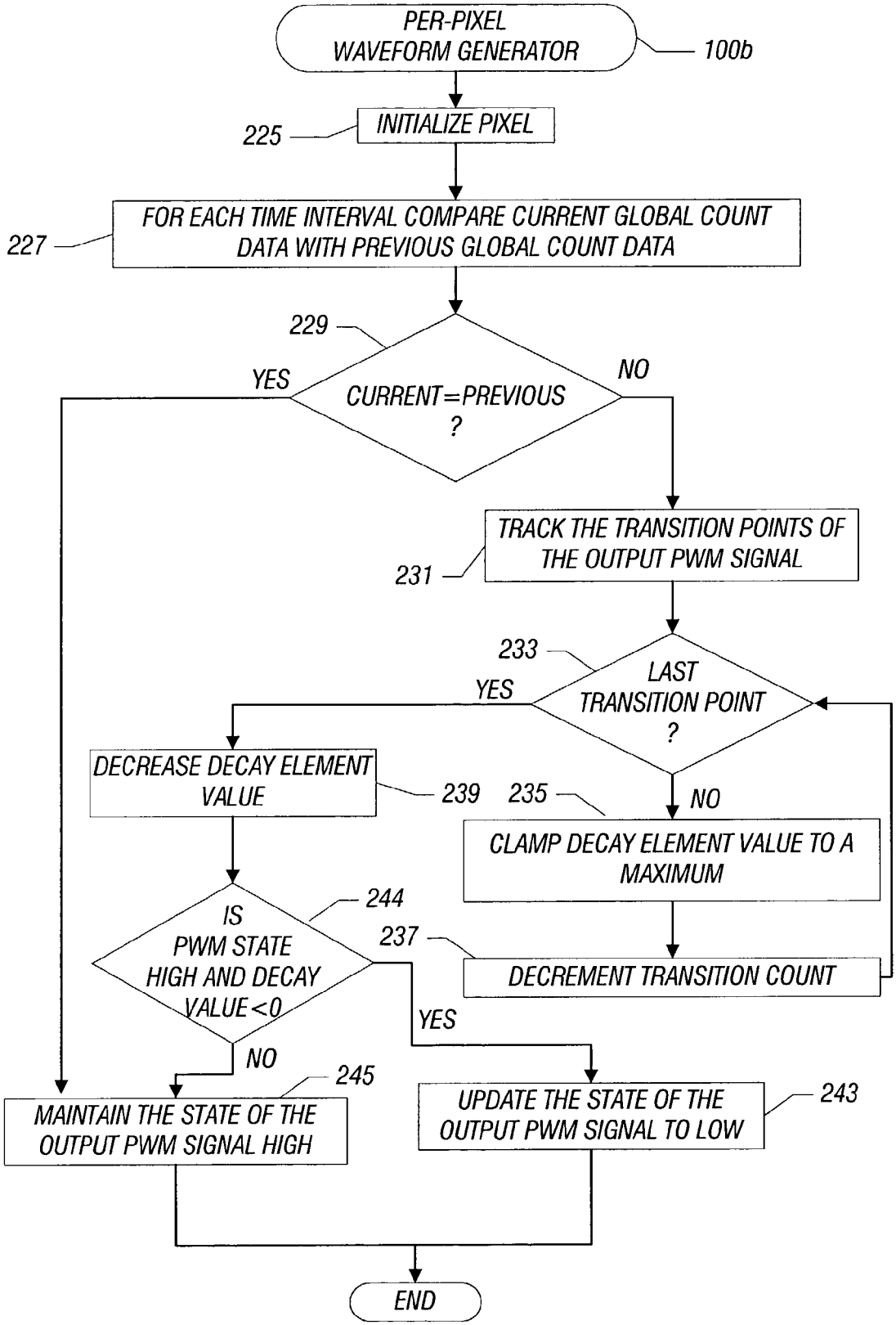
FIG. 4B shows per-pixel waveform generator circuitry to selectively update pulse width modulated waveforms while driving pixels of the display device of FIG. 1 according to another embodiment of the present invention.

Turning to FIG. 4B, per-pixel waveform generator circuitry 100*b* with the comparator 130 capable of performing at least three different comparisons may selectively update an output pulse width modulated signal while driving the pixel 110 in another embodiment of the present invention. At block 225, each pixel 110 may be initialized. As an example, the steps 200 through 206 shown in FIG. 4A may be undertaken at this point. At block 227, for each time interval of a display refresh period, current global count value may be compared to the previous global count value.

A check at diamond 229 may ascertain whether the current and previous global count values are same or different. When the two global count values are determined to be different, potential transition points indicating a transition from one logic state to another logic state in the output PWM signal may be tracked at block 231. Another check at diamond 233 may determine whether the last transition point indicative of a maximum number of defined transitions based on a transition count is reached or not. When the last transition point is not reached, the decay element 135 is not updated. That is, the decay data 140 located at the decay element 135 may be clamped to a maximum value which may be based on the precision of the decay element 135 at block 235. Thereafter, the transition count, which keeps track of the number of transition points, may be decremented at block 237. However, if at diamond 233 the transition point is determined to be an intermediate transition point of the output PWM signal then, the decay element 135 data 140 may be decreased at block 239.

A check at diamond 241 may indicate whether the state of the output PWM signal is high and the decay data 140 is less then zero. If both of the conditions are true, that is the state of the output PWM signal is high and the decay data 140 at the decay element 135 is determined to be less than zero then, the state of the output PWM signal may be updated to a low logic state at block 243 (e.g., a digital logic level may be changed from "1" to "0" via a single transition). Alternatively, if the two above described conditions are determined to be false, i.e., the state of the output PWM signal is low and the decay data 140 is greater than zero then, the state of the output PWM signal is left unchanged at block 245. In particular, the logic state of the output PWM signal is maintained at a high logic state (e.g., a digital logic level "1"), which may have been set earlier when the video frame was started for the display refresh period.

According to another embodiment, a processor-based system may include a plurality of pixel cells, forming a pixel array. Each pixel cell may be driven by a plurality of local drive circuits. Each local drive circuit may be associated with a different pixel cell of the pixel array to receive pixel video data indicative of an optical output from a different pixel cell and receive a dynamically changing count data being shared among the plurality of pixel cells. For each different pixel cell, the corresponding local drive circuit may generate a single-edged PWM waveform accordingly.

Figure 5:
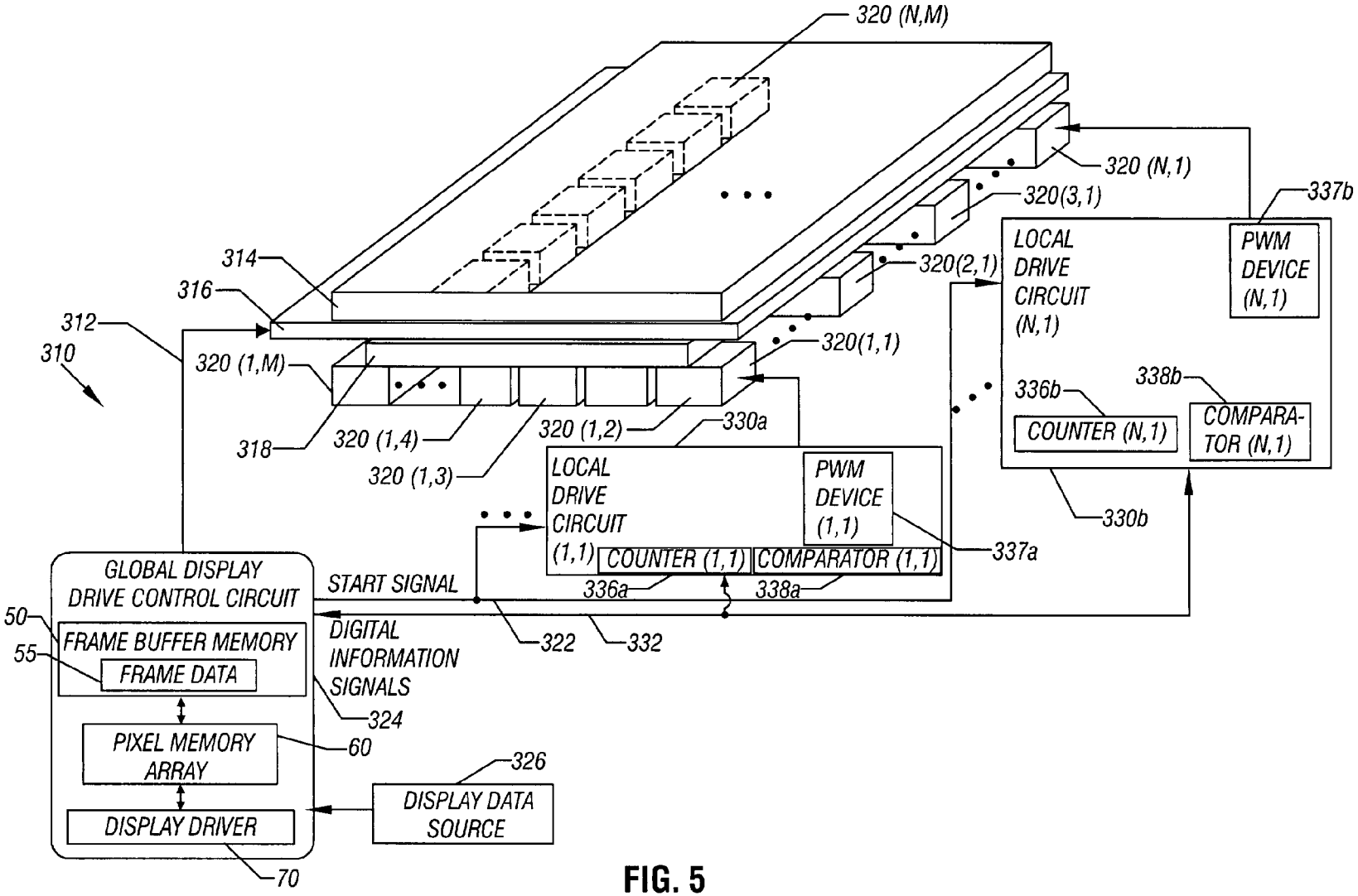
FIG. 5 is a schematic depiction of a display system based on the pixel architecture of FIG. 1 according to one embodiment of the present invention.

A processor-based display system 310 (e.g., the display device 20 shown in FIG. 1, such as a liquid crystal display including a spatial light modulator (SLM)) shown in FIG. 5 includes a liquid crystal layer 318 according to one embodiment of the present invention. In particular, the liquid crystal layer 318 may be sandwiched between a transparent top plate 316 and a plurality of pixel electrodes 320(1, 1) through 320(N, M) corresponding to the pixel electrodes 105 of FIG. 1, forming a pixel array comprising a plurality of display elements (e.g., pixels). In some embodiments, the top plate 316 may be made of a transparent conducting layer, such as indium tin oxide (ITO).

Applying voltages across the liquid crystal layer 318 through the top plate 316 and the plurality of pixel electrodes 320(1, 1) through 320(N, M) enables driving of the liquid crystal layer 318 to produce different levels of intensity on the optical outputs at the plurality of display elements, i.e., pixels, allowing the display on the display system 310 to be altered. A glass layer 314 may be applied over the top plate 316. In one embodiment, the top plate 316 may be fabricated directly onto the glass layer 314. A global display drive control circuit 324 may include the display driver 70 to drive the pixel electrodes 320, the pixel memory array 60 to store digital information indicative of an optical output from each display element, i.e., pixel, and the frame buffer memory 50 to store the frame data 55. A display data source 326 may provide video data in accordance with one embodiment of the present invention.

In some embodiments, the global display drive control circuit 324 applies bias potentials 312 to the top plate 316. Additionally, the circuit 324 provides a start signal 322 and a digital information signal 332 to a plurality of local drive circuits (1, 1) 330*a* through (N, 1) 330*b* corresponding to the waveform generators 100 of FIG. 1, each local drive circuit may be associated with a different display element being formed by the corresponding pixel electrode of the plurality of pixel electrodes 320(1, 1) through 320(N, 1), respectively.

One technique in accordance with an embodiment of the present invention involves controllably driving the display system 310 using pulse-width modulation (PWM). More particularly, for driving the plurality of pixel electrodes 320(1,1) through 320(N, M), each display element may be coupled to a different local drive circuit of the plurality of local drive circuits (1, 1) 330*a* through (N, 1) 330*b*, as an example. To hold and/or store any digital information intended for a particular display element, a plurality of digital storage elements (e.g. the pixel memory array 60 including the pixel memory cells 65 shown in FIG. 1) may be provided, each pixel memory cell may be remotely located and associated with a different local drive circuit of the plurality of local drive circuits (1, 1) 330*a* through (N, 1) 330*b*, for example.

Likewise, for generating a single-edged PWM waveform based on the respective digital information, a plurality of PWM devices (1, 1) 337*a* through (N, 1) 337*b* corresponding to the PWM circuitry 150 of FIG. 1 may be provided in order to drive a corresponding display element, such as the pixel cell 90. In one case, each PWM device of the plurality of PWM devices (1, 1) 337*a* through (N, 1) 337*b* may be associated with a different local drive circuit of the plurality of local drive circuits (1, 1) 330*a* through (N, 1) 330*b*.

To generate a modulated signal within each display refresh period, a counter of a plurality of counters (1, 1) 336*a* through (N, 1) 336*b* corresponding to the decay elements 135 of FIG. 1 may be associated with a different local drive circuit of the plurality of local drive circuits (1, 1) 330*a* through (N, 1) 330*b*. In a similar fashion, a comparator of a plurality comparators (1, 1) 338*a* through (N, 1) 338*b* corresponding to the comparators 130 of FIG. 1 may be provided for a different local drive circuit of the plurality of local drive circuits (1, 1) 330*a* through (N, 1) 330*b*.

Consistent with one embodiment of the present invention, the global display drive control circuit 324 may receive video data input and may scan the pixel array in a row-by-row manner to drive each pixel electrode of the plurality of pixel electrodes 320(1,1) through 320(N, M). Of course, the processor-based display system 310 may comprise any desired arrangement of one or more display elements. Examples of the display elements include spatial light modulator devices, emissive display elements, non-emissive display elements and current and/or voltage driven display elements.

One embodiment of the display system 310 may be based on a digital system architecture that uses pulse-width modulation to produce color in spatial light modulator devices arranged in a matrix array comprising a plurality of digital pixels, each digital pixel including one or more sub-pixels. In one case, the matrix array may include a plurality of columns and a plurality of rows. The columns and rows may be driven by a separate global drive circuit, which may enable localized generation of a single-edged PWM voltage or current waveforms at a digital pixel level to drive the plurality of digital pixels. Alternatively, the plurality of digital pixels may be configured in any other useful or desirable arrangement.

Several additional advantages may be derived in other embodiments. For example, by supporting a system architecture that generates a single "ON" pulse, the device can better control the LC material. This control may be lacking in some situations with approaches that add up multiple non-overlapping pulses to build the PWM waveform. Accordingly, the pixel hardware may be advantageously simplified to allow small sizes. This scheme may allow a duty cycle to vary as a linear function of pixel value with a single "ON" pulse. In this way, PWM may enable digital pixel architectures for SLM devices to design a digital SLM. Additionally, a partitioning of functionality between the global display drive control circuit 324 and the local drive circuits 330 may advantageously desire reading of the pixel data or value 125 only once for each pixel in every display refresh period, substantially reducing the bandwidth requirements necessary to support a digital drive scheme based on one embodiment of the present invention.

For example, the counter 336 may be an n-bit counter, wherein "n" is the number of bits of color depth in the particular pixel. In various embodiments of the system 310, there may be more than one such counter 336. For example, a particular application may call for a red-green-blue (RGB) color scheme using 16 bits to represent the three sub-pixels, and in which red and blue each have five bits and green has six bits of the sixteen. In such a case, a six-bit counter may drive the "green pixels" (which may alternatively be called sub-pixels), while a five-bit counter may drive the red and blue sub-pixels. In other embodiments, a single, configurable or programmable counter may be used in an interleaved or time-sliced mode in which, for example, it counts to a first value for the red pixels, a second value for the green pixels, and a third value for the blue pixels. However, one embodiment of the invention is not limited to use in the RGB color space. As another example, another embodiment of the invention may find utility outside the realm of SLMs, such as in driving flat panel plasma or LCD displays or the like. In one case, separated pixel memory array 60 and local drive circuits 330 may be fabricated on more convenient areas of a die, on separate die, or even using different fabrication or semiconductor technologies.

Advantageously, the pixel memory array 60 and the pixel display array 40 of FIG. 1 may be physically distinct and formed by the pixel electrodes 320 (1, 1) through 320 (N, M) shown in FIG. 5. That is, the cells 65 of the pixel memory array 60 (or at least some of them, in some embodiments) are located outside the boundaries of the pixel display array 40. The circuitry for local drive circuit 330 provided beneath each pixel cell 90 is thus reduced, by moving at least its associated pixel data value storage cell to a remote location. The size of each pixel cell 90 may be significantly reduced, and thus the resolution of the display is improved. Because the output PWM signal update is decoupled from the pixel data or value 125 update, in some cases, a higher quality display may be provided. The pixel memory array 60 may be independently sized without impacting the pixel cell 90 size. Redundant pixel memory cells 65, and other desirable features, may be added to the pixel memory array 60 without impacting the size of the pixel display array 40 or its individual pixel cells 90.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

sending an update value to a first display element;

using said update value only once in a display refresh period to generate a pulse width modulated signal that drives said first display element;

receiving at said first display element said update value including first digital data indicative of an optical output from said first display element within the display refresh period; and forming for said first display element the modulated signal including one transition separating a first pulse interval from a second pulse interval in the display refresh period.

2. The method of claim 1, including:

partitioning the different display refresh period into a first and a second time intervals;

receiving a first reference data corresponding to said first time interval and a second reference data corresponding to said second time interval, said first and second reference data being common between said first display element and a second display element; and comparing said first reference data to said second said reference data.

3. The method of claim 2, including:

deriving the timing of said one transition of the modulated signal within the display refresh period based on said first digital data and said comparison of said first and second reference data.

4. The method of claim 3, including:

tracking at said first display element the number of times the modulated signal to change a logic state against a threshold; and in response to reaching the threshold, causing said one transition to change the logic state of the modulated signal.

5. The method of claim 3, including:

starting a display of a video frame within the different display refresh period; and setting the modulated signal to an "ON" logic state at the beginning of said video frame.

6. The method of claim 3, including causing said one transition from an "ON" logic state to an "OFF" logic state in the modulated signal when said first and second reference data are different.

7. The method of claim 3, including maintaining an "ON" logic state in the modulated signal when said first and second reference data are substantially equal.

8. The method of claim 3, including:

tracking the modulated signal for transition points indicative of a potential change in a logic state of the modulated signal;

keeping a count of the transition points; and determining the logic state of the modulated signal based on the count.

9. The method of claim 3, including performing pulse width modulation to form the modulated signal.

10. An apparatus comprising:

a first display element;

a controller to send an update value to said first display element;

a waveform generator operably coupled to said controller and first display element to use said update value only once in a display refresh period to generate a pulse width modulated signal that drives said first display element, receive said update value including first digital data indicative of an optical output from said first display element within the display refresh period and form for said first display element the modulated signal including one transition separating a first pulse interval from a second pulse interval in the display refresh period.

11. The apparatus of claim 10, said waveform generator comprising a decay element to:

partition the display refresh period into a first and a second time intervals;

receive a first reference data corresponding to said first time interval and a second reference data corresponding to said second time interval, wherein said first and second reference data being common between said first display element and a second display element;

compare said first reference data to said second reference data; and derive the timing of said one transition of the modulated signal within the display refresh period based on said first digital data and said comparison of said first and second reference data.

12. The apparatus of claim 11, wherein said decay element to:

track at said first display element the number of times the modulated signal to change a logic state against a threshold; and in response to reaching the threshold, causing said one transition to change the logic state of the modulated signal.

13. The apparatus of claim 11, further comprising:

a driver to start a display of a video frame within the display refresh period and set the modulated signal to an "ON" logic state at the beginning of said video frame; and a plurality of memory cells forming a memory array operably coupled to said driver, wherein a first memory cell is associated with said first display element.

14. The apparatus of claim 13, said controller further comprising:

a first storage device to provide said first digital data in the display refresh period to said first memory cell; and control logic operably coupled to said memory array to provide said first and second reference data to said first display element.

15. The apparatus of claim 13, said decay element includes a counter to cause said one transition from the "ON" logic state to an "OFF" logic state in the modulated signal when said first and second reference data are different.

16. The apparatus of claim 13, said decay element includes a counter to maintain the "OFF" logic state in the modulated signal when said first and second reference data are substantially equal.

17. The apparatus of claim 13, wherein the first and second display elements include a plurality of display elements forming an array of display pixels in a liquid crystal display.

18. The apparatus of claim 17, wherein said liquid crystal display includes a spatial light modulator.

19. A processor-based system comprising:

a plurality of pixel cells forming a pixel array;

a controller to send an update value to a different pixel cell of the pixel array; and a plurality of drive circuits, each said drive circuit operably coupled with said different pixel cell of the pixel array to use said update value only once in a display refresh period to generate a pulse-width modulated signal that drives said different pixel cell, wherein each said drive circuit comprising a waveform forming device to:

receive said update value including first digital data indicative of an optical output from said different pixel cell within the display refresh period; and form for said different pixel cell of the pixel array the modulated signal including one transition separating a first pulse interval from a second pulse interval in the display refresh period.

20. The processor-based system of claim 19, said waveform forming device comprising a decay element to:

partition the display refresh period into a first and a second time intervals;

receive a first reference data corresponding to said first time interval and a second reference data corresponding to said second time interval, wherein said first and second reference data being common between said plurality of pixel cells;

compare said first reference data to said second reference data; and derive the timing of said one transition of the modulated signal within the display refresh period based on and said first digital data said comparison of said first and second reference data.

21. The processor-based system of claim 20, wherein said decay element to:

track at said different pixel cell the number of times the modulated signal to change a logic state against a threshold; and in response to reaching the threshold, causing said one transition to change the logic state of the modulated signal.

22. The processor-based system of claim 20, further comprising:

a driver to start a display of a video frame within the display refresh period and set the modulated signal to an "ON" logic state at the beginning of said video frame; and a plurality of memory cells forming a memory array operably coupled to said driver, wherein a first memory cell is associated with said different pixel cell.

23. The processor-based system of claim 22, said decay element includes a counter to cause said one transition from the "ON" logic state to an "OFF" logic state in the modulated signal when said first and second reference data are different.

24. The processor-based system of claim 22, said decay element includes a counter to maintain the "OFF" logic state in the modulated signal when said first and second reference data are substantially equal.

25. The processor-based system of claim 22, wherein the pixel array includes a liquid crystal display.

26. The processor-based system of claim 25, wherein said liquid crystal display includes a spatial light modulator.

27. The processor-based system of claim 20, said controller further comprising:

a first storage device to provide said first digital data in the display refresh period to said first memory cell; and control logic operably coupled to said memory array to provide said first and second reference data for said different pixel cell.

* * * * *